US005867188A

United States Patent [19]

Murayama et al.

[11] Patent Number: 5,867,188

[45] Date of Patent: Feb. 2, 1999

[54] INK JET PRINTER

[75] Inventors: Susumu Murayama; Takayuki Okuda; Atsushi Nishizawa; Satoshi Fujioka; Masanori Yoshida, all of Nagano, Japan

[73] Assignee: Seiko Epson Corporation, Tokyo-To, Japan

[21] Appl. No.: 621,779

[22] Filed: Mar. 22, 1996

[30] Foreign Application Priority Data

Mar. 22, 1995 [JP] Japan ..... 7-088882

[51] Int. Cl.[6] ..... B41N 2/01

[52] U.S. Cl. ..... 347/37; 347/43; 347/50; 400/352

[58] Field of Search ..... 347/5, 37, 49, 347/50, 40, 43; 400/352

[56] References Cited

U.S. PATENT DOCUMENTS

| | | | |
|---|---|---|---|
| 4,503,442 | 3/1985 | Barbero et al. | 346/140 R |
| 4,576,496 | 3/1986 | Schwarz et al. | 400/352 |
| 4,907,018 | 3/1990 | Pinkerpell et al. | 347/50 |
| 5,152,620 | 10/1992 | Gomoll et al. | 400/124 |
| 5,467,116 | 11/1995 | Nakamura et al. | 347/50 |

FOREIGN PATENT DOCUMENTS

| | | |
|---|---|---|
| 0 174 817 A2 | 3/1986 | European Pat. Off. . |
| 0 622 233 A2 | 11/1994 | European Pat. Off. . |
| 0 710 568 A2 | 5/1996 | European Pat. Off. . |
| 62-52717 | 11/1987 | Japan . |
| 02188283 | 7/1990 | Japan . |
| 2-188283 | 7/1990 | Japan . |
| 3-104643 | 5/1991 | Japan . |
| 2158778 | 11/1985 | United Kingdom . |

OTHER PUBLICATIONS

French Search Report dated Apr. 11, 1997.
British Search Report dated Jun. 11, 1996.

*Primary Examiner*—Joseph Hartary
*Attorney, Agent, or Firm*—Stroock & Stroock & Lavan LLP

[57] ABSTRACT

The ink jet printer is provided which eliminates play between a carriage supporting an ink jet head and a guide shaft, allows the ink jet head to be releasably attached to the carriage, and provides reliable electrical connection between the ink jet head and the carriage with a reduced number of parts. An embodiment of the ink jet printer of the invention includes a guide shaft extending in a direction orthogonal to a direction in which paper is forwarded. A carriage is slidably mounted on the shaft, moving in reciprocal directions while being guided by the guide shaft. An ink jet head, releasably attached to the carriage, prints ink dots on the paper for forming a printed image by jetting ink out of nozzles. A first electrically connecting portion is arranged on the carriage. A second electrically connecting portion is arranged on the ink jet head so as to come in pressure contact with the first electrically connecting portion. A biasing member provides a pressing force between the first electrically connecting portion and the second electrically connecting portion.

21 Claims, 12 Drawing Sheets

INK JET PRINTER

BACKGROUND OF THE INVENTION

The invention relates generally to an ink jet printer, and, in particular, to the structure of a carriage having an ink jet printing head (hereinafter referred to simply as the "head") of the ink jet printer attached thereto. More specifically, the invention is directed to a new carriage structure for preventing play between the carriage and hence the head, and a guide shaft of the carriage; a new carriage structure which also allows for connecting the head to the carriage in a manner where it may be easily released and reattached to the carriage.

As is known in the prior art, and in particular, as is depicted in FIGS. 20 and 21, a conventional ink jet printer generally includes: a guide shaft 1101 extending in a direction orthogonal to a direction Y in which paper P is forwarded; a carriage 1102 mounted on guide shaft 1101 for reciprocal motion along guide shaft 1101 as indicated by arrow X1–X2 while guided by guide shaft 1101. An ink jet head 1103 is attached to carriage 1102 and prints ink drops on paper P by jetting ink. A number of nozzles n are formed on the surface 1103*a* of head 1103 facing paper P. Ink is selectively jetted out of nozzles n to make predetermined printed ink dots forming a printed image.

Carriage 1102 is slidable along guide shaft 1101. Therefore, a slight clearance is generally provided between guide shaft 1101 and the bearing portion of carriage 1102. As a result, unless made to a precise measurement, carriage 1102 may, in some cases, rotate (play) about an axis orthogonal to the plane of paper P, or in other words, with respect to guide shaft 1101, in the direction indicated by arrows T1 and T2. For example, carriage 1102 may, in some cases, slightly rotate in the direction of arrow T1 when moving in the direction of arrow X1 and slightly rotate in the direction of arrow T2 when moving in the direction of arrow X2.

When carriage 1102 rotates (plays) when moving in both directions this way, head 1103 also rotates, and the position of nozzles n are thus, also slightly displaced from a position parallel with guide shaft 1101. As a result, an inherent problem with this system is that the printing quality diminishes due to this misalignment. As shown in FIG. 20 in particular, in the case where head 1103 has a plurality (three in FIG. 22) of nozzle arrays N1, N2, N3 arranged side by side in the direction parallel with guide shaft 1101, also known as the carriage moving direction, the diminishment of printing quality may be aggravated. That is, when head 1103 is rotated in the direction of either arrows T1 or T2, the amount of displacement of nozzles n in the direction Y is larger in nozzle arrays N1 and N3 because they are offset further from the axis of rotation than nozzle array N2 in the middle and closest to the axis of rotation.

An additional problem which may arise if carriage 1102 plays in the direction of either of arrows T1 or T2 when moving in the directions of arrows X1–X2, respectively, is that the printing noise may be increased by such play. To overcome these problems, play between carriage 1102 and guide shaft 1101 should be reduced or eliminated.

As shown in FIGS. 23–27, a printer known from Examined Japanese Patent Publication No. Sho. 62-52717 includes a structure in which a carriage 1108 is supported by a guide shaft 1104 so that play between carriage 1108 and guide shaft 1104 is reduced. Carriage 1108 is mounted to ball bearings 1105*a*, 1105*b* and 1105*c*. Ball bearings 1105*a*, 1105*b*, 1105*c* come in contact with guide shaft 1104 at a lower surface and obliquely at upper surfaces. A slide bearing 1107 comes in contact with a flat portion 1104*a* of guide shaft 1104 while biased onto guide shaft 1104 by a flat spring 1106.

Further, as shown in FIG. 26, it is known from Unexamined Japanese Patent Publication No. Hei. 2-188283 to mount a carriage 1109 about a guide shaft 1110. In this case, a magnet 1111 is mounted on carriage 1109. Play of carriage 109 with respect to guide shaft 1110 is reduced or eliminated by utilizing the magnetic attracting force (biasing force) obtained by arranging magnet 1111 at a portion of carriage 1109 confronting guide shaft 1110.

On the other hand, another conventional ink jet printer well known in the prior art has the head attached to the carriage in a manner so as to be releasable and reattachable with respect to the carriage. If such a design is adopted for a printer, wiring for driving the nozzles on the head must be devised since the carriage and the head cannot be directly connected by means of solder or the like if it is to be removable.

Thus, as shown in FIG. 27, it is known from Unexamined Japanese Patent Publication No. Hei. 3-104643 to mount a carriage 1112 on a guide shaft 1110. An end 1113 of an FPC (Flexible Printed Cable) is attached to a carriage 1112 and a board 1115 is attached to a head 1114. Board 1115 is connected to end 1113 of the FPC so as to be in pressure contact therewith. Head 1114 is releasably attached to carriage 1112. It may be noted that the other end of the FPC is typically connected to a control board of a printer main body.

In such a structure, end 1113 of the FPC must be reliably brought into pressure contact with board 1115. In the structure disclosed in the aforementioned patent publication, a hook member 1116 for fixing head 1114 to carriage 1112 is biased in a direction to cause hook member 1116 to grasp head 1114 by a spring 1117, whereby board 1115 is brought into pressure contact with end 1113 of the FPC in a reliable manner.

The prior art devices have been satisfactory, however when one attempts to achieve the object of eliminating play between the carriage and the guide shaft as well as the object of releasably attaching the head to the carriage at the same time, the biasing member for eliminating the play between the carriage and the guide shaft (i.e., flat spring 1106 or magnet 1111 in the prior art, FIGS. 23 through 25 and 26, respectively) and the biasing member for bringing the board of the head into pressure contact with the FPC (i.e., spring 1117 of the prior art, FIG. 27) must be formed as separate components. In the conventional examples, the number of parts and the complexity would be increased, which in turn increases the cost and size of the carriage and hence the printer. This is yet another problem to be overcome.

Accordingly, a printer that overcomes the aforementioned disadvantages and limitations, which readily minimizes carriage play against the guide shaft and allows for easy removal and reattachment is desired.

SUMMARY OF THE INVENTION

An ink jet printer is provided in which play between the carriage and the guide shaft is eliminated and in which the head is releasably and reliably attached to the carriage. The ink jet printer further allows the head to be reliably electrically connected to the carriage. Yet, the ink jet printer of the invention accomplishes this with a reduced number of parts, size, complexity and cost.

An embodiment of the ink jet printer of the invention includes a guide shaft extending in a direction orthogonal to a direction in which paper is forwarded. A carriage is slidably mounted on the shaft, moving in reciprocal directions while being guided by the guide shaft. An ink jet head, releasably attached to the carriage, prints ink dots on the paper for forming a printed image by jetting ink out of nozzles. A first electrically connecting portion is arranged on the carriage. A second electrically connecting portion is arranged on the ink jet head so as to come in pressure contact with the first electrically connecting portion when positioned in the carriage for printing. A biasing member reliably provides a pressing force between the first electrically connecting portion and the second electrically connecting portion, and between the carriage and the guide shaft for reducing or eliminating play.

Thus, the ink jet printer according to this embodiment of the invention allows the carriage to move reciprocally while being guided by the guide shaft, whereby ink is jetted out of the ink jet head to thereby print an ink dot on the paper for forming an image. Because a pressing force is given between the guide shaft and the carriage, play between the carriage and the guide shaft is minimized or prevented. Therefore, satisfactory printing quality and reduced noise can be obtained.

Further, the carriage and the ink jet head are electrically connected to each other by bringing the first electrically connecting portion arranged on the carriage into pressure contact with the second electrically connecting portion arranged on the ink jet head. Therefore, the ink jet head can be releasably attached to the carriage while maintaining a reliable electrical connection.

The biasing member for pressing the first electrically connecting portion towards the second electrically connecting portion is also used as the biasing member for pressing the guide shaft towards the carriage. Therefore, the number of biasing members can be reduced accordingly. Hence, the ink jet printer according to this embodiment of the invention not only can eliminate play between the carriage and the guide shaft, but also can allow the head to be releasably attached to the carriage and allow the head to be electrically connected to the carriage reliably with a reduced number of parts, complexity, size and cost.

A preferred embodiment of the ink jet printer of the invention has, in the ink jet head, a plurality of nozzle arrays in the carriage moving directions. Thus, the ink jet printer according to this embodiment of the invention allows a plurality of nozzle arrays to jet ink and print ink dots for forming an image along the carriage moving direction. Therefore, printing with a higher resolution can be obtained.

If the carriage plays when moving in both directions in the case where the ink jet head has a plurality of nozzle arrays in the carriage moving directions, impairment in printing quality is aggravated. However, in the printer according to this embodiment of the invention, pressing force is given by the biasing member. Therefore, play between the carriage and the guide shaft can be prevented, and this not only allows printing with a higher resolution to be obtained satisfactorily, but also contributes to minimizing the cost, size and complexity of the ink jet printer.

Another preferred embodiment of the ink jet printer of the invention includes a monochromatic printing ink jet head and a color printing ink jet head, either or both of which may be provided as the ink jet head in the ink jet printer according to the invention.

The ink jet printer according to this embodiment of the invention allows both monochromatic prints to be made by attaching the monochromatic printing ink jet head to the carriage, and color prints to be made by attaching the color printing ink jet head in place of the monochromatic printing ink jet head. In the case of color printing, or full-color printing in particular, red, blue, and yellow ink dots must be jetted out in a careful alignment. Therefore, the color printing ink jet head must have at least 3 nozzle arrays in the carriage moving directions. If the carriage plays when moving in both directions in this case, impairment in printing quality is aggravated due to the outside nozzle arrays being displaced further due to the play. However, the printer according to this embodiment of the invention can minimize or prevent play between the carriage and the guide shaft. Therefore, a satisfactory color image can be produced. In addition, a reduction of cost, size and complexity can be attained since the biasing member for allowing a reliable electrical connection during replacement of the head serves also as the biasing member for preventing play. That is, the construction according to this embodiment of the invention allows a small-sized color and monochrome printer to be obtained; the printer being capable of providing both high quality monochromatic as well as high quality color prints.

In yet another preferred embodiment of the ink jet printer of the invention, the carriage has positioning members for regulating a position at which the ink jet head is arranged relative to the carriage; and the biasing member biases the ink jet head toward these positioning members.

The ink jet printer according to this embodiment of the invention thus allows the ink jet head to be positioned properly, which in turn allows high quality printing to be assured.

In still another preferred embodiment of the ink jet printer of the invention, a space is formed in the carriage adjacent to both the guide shaft and the ink jet head and the biasing member is accommodated in this space. Thus, the ink jet printer according to this embodiment of the invention allows further reduction of the size of the ink jet printer.

In an exemplary embodiment of the ink jet printer of the invention, the biasing member is constructed of a compression spring. The carriage includes a pressure member and a sliding portion and the pressure member has a receiving portion for receiving the compression spring, the sliding portion coming in sliding contact with the guide shaft. The first electrically connecting portion has an end thereof connected to a control section of a printer main body and the other end thereof forming an end of a flexible printed cable (FPC) arranged in parallel with the guide shaft within the carriage. The second electrically connecting portion is constructed of a board arranged in parallel with the end of the FPC and the receiving portion of the pressure member and the end of the FPC are arranged in parallel with the guide shaft in the space adjacent to both the guideshaft and the head. Thus, the ink jet printer according to this embodiment of the invention allows further reduction of the cost, size and complexity of the ink jet printer.

Further, in this embodiment the receiving portion of the pressure member, the first electrically connecting portion, and the second electrically connecting portion may all be arranged in parallel with the guide shaft. Therefore, even further reduction of the cost, size and complexity of the ink jet printer can be attained.

Accordingly, it is an object of the present invention to provide an ink jet printer with an easily a removable ink jet head.

It is also an object of the present invention to provide a carriage assembly which reduces play with respect to the guide shaft.

It is another object of the present invention to provide a single biasing member which provides both secure electrical contact between the head and the carriage as well as providing a force pressing the carriage against the guide shaft for reducing play.

Still other objects and advantages of the invention will in part be obvious and will in part be apparent from the specification.

The invention accordingly comprises the features of construction, combinations of elements and arrangement of parts which will be exemplified in the constructions hereinafter set forth, and the scope of the invention will be indicated in the claims.

BRIEF DESCRIPTION OF THE DRAWINGS

For a more complete understanding of the invention, reference is made to the following description taken in connection with the accompanying drawings, in which like numbers represent like parts and.

DETAILED DESCRIPTION OF THE INVENTION

Figure 1:
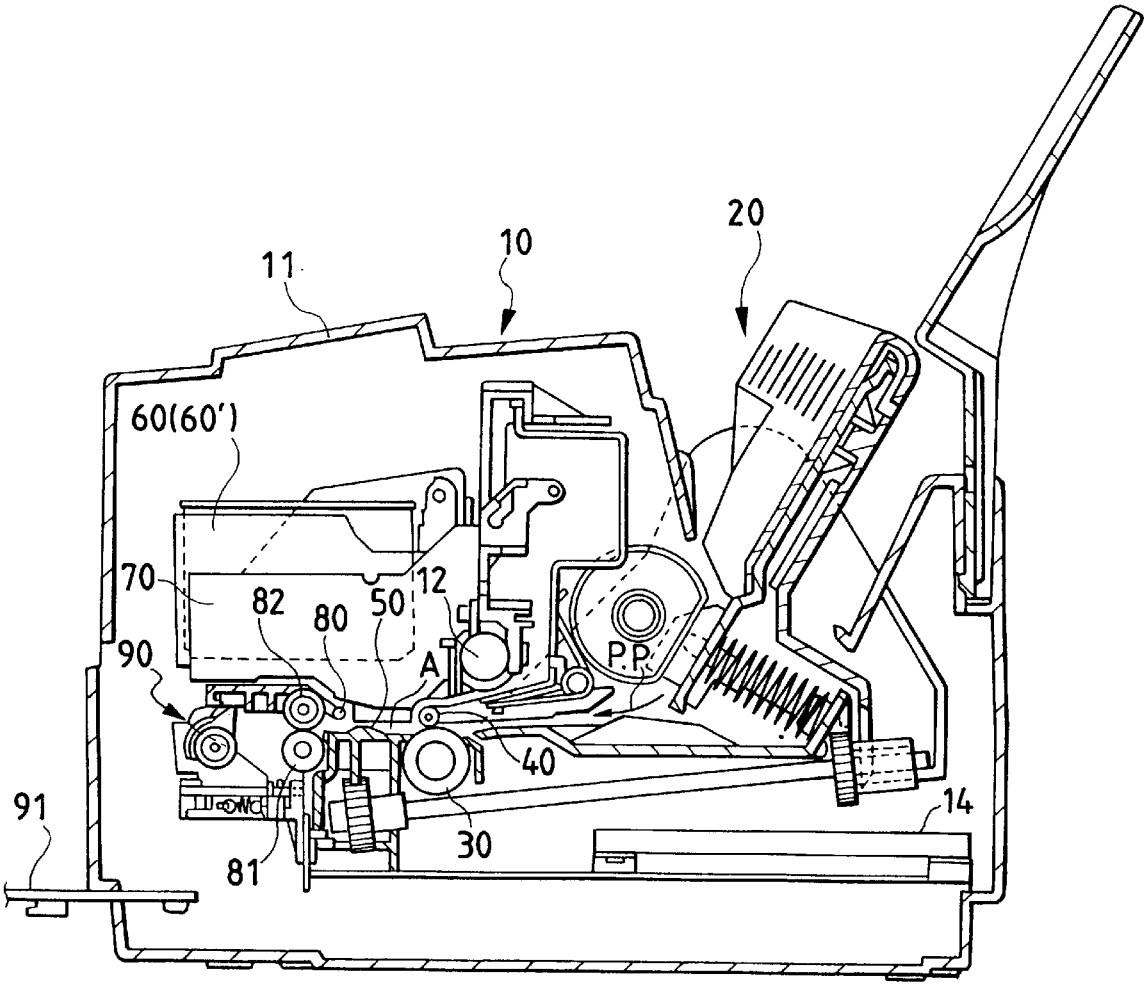
FIG. 1 is a side sectional view showing the internal construction of an ink jet printer constructed in accordance with an embodiment of the present invention.

Referring now to FIG. 1, the ink jet printer depicted includes a printer main body 10 having a case 11. An automatic sheet feeder 20 is incorporated into main body 10. A sheet forward roller 30 is mounted in main body 10 along a paper sheet feed path PP and contacts a pinch roller 40 mounted within main body 10. Pinch roller 40 is driven by sheet forward roller 30. A regulating member 50, mounted within case 11 downstream along paper sheet feed path PP guides the back of paper fed by rollers 30 and 40. A guide roller 80 is rotatably mounted in case 11 downstream of regulating member 50 along paper feed path PP, and contacts a pair of sheet discharge rollers 81, 82 mounted in main body 10. A sheet discharge section 90 mounted within case 11 downstream of guide roller 80, discharges paper from paper sheet feed path PP. Further, a sheet discharge tray 91 in which discharged sheets of paper may be piled up is disposed in the front of main body 10.

Main body 10 includes a print area A along the paper sheet feed path. A guide shaft 12 supports a carriage 70. An ink jet head 60 is releasably attached to carriage 70 so that ink jet head 60 makes images on a paper by jetting ink drops within print area A.

The paper (not shown) fed by automatic sheet feeder 20 reaches sheet forward roller 30 via a paper path that is generally curved so as to be somewhat recessed as a whole, and is fed out of sheet forward roller 30 with the forwarding angle regulated by pinch roller 40. A leading end of the paper forwarded out of sheet forward roller 30 is guided by regulating member 50 that also serves as a guide member, so that the distance between the paper and ink jet head 60 is regulated. Under this condition, ink dots are jetted out of ink jet head 60 onto a surface of the paper to make a printed image. It is at print area A that this printing is done. The printed sheet of paper is then discharged onto sheet discharge tray 91 via sheet discharge rollers 81 and 82 at discharge section 90.

Figure 2:
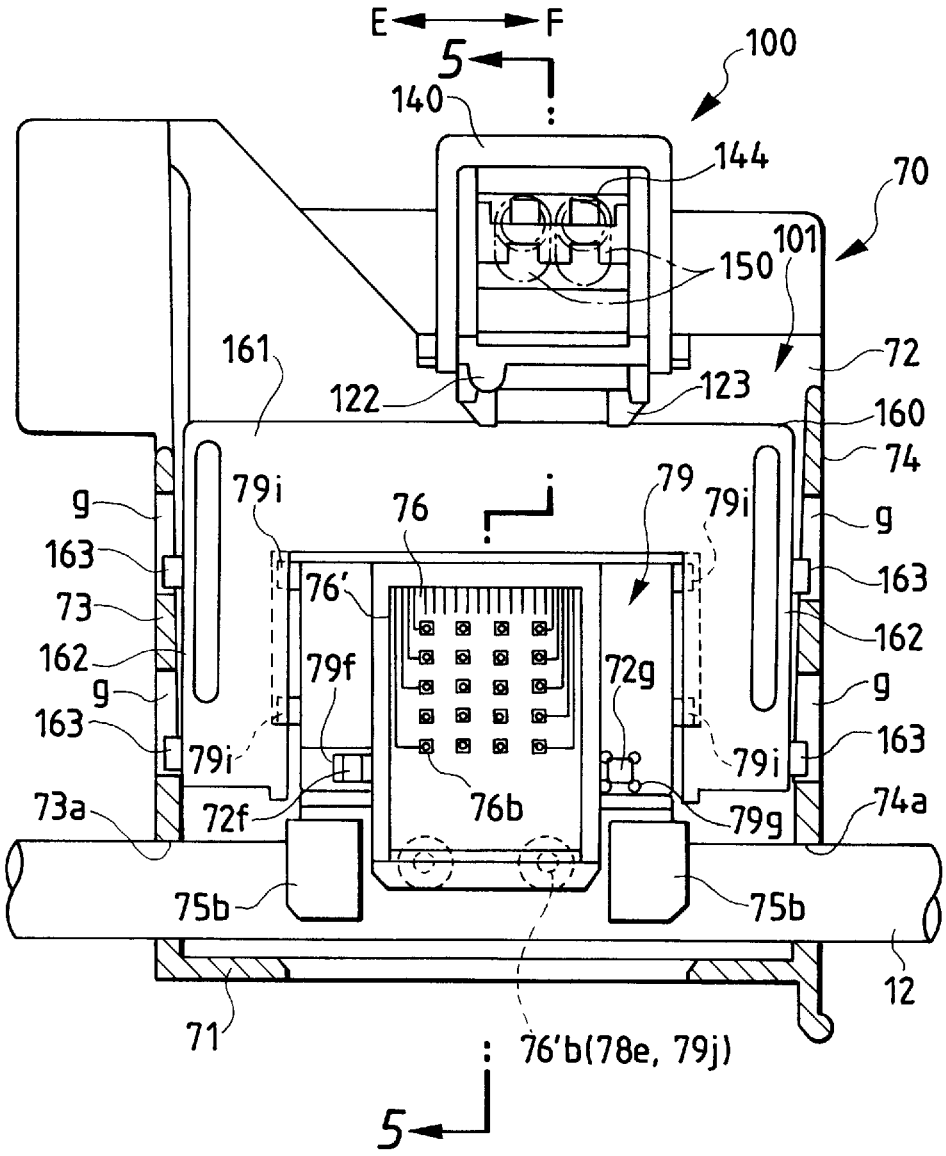
FIG. 2 is a partial elevational view of the front of a carriage constructed in accordance with an embodiment of the present invention.
Figure 3:
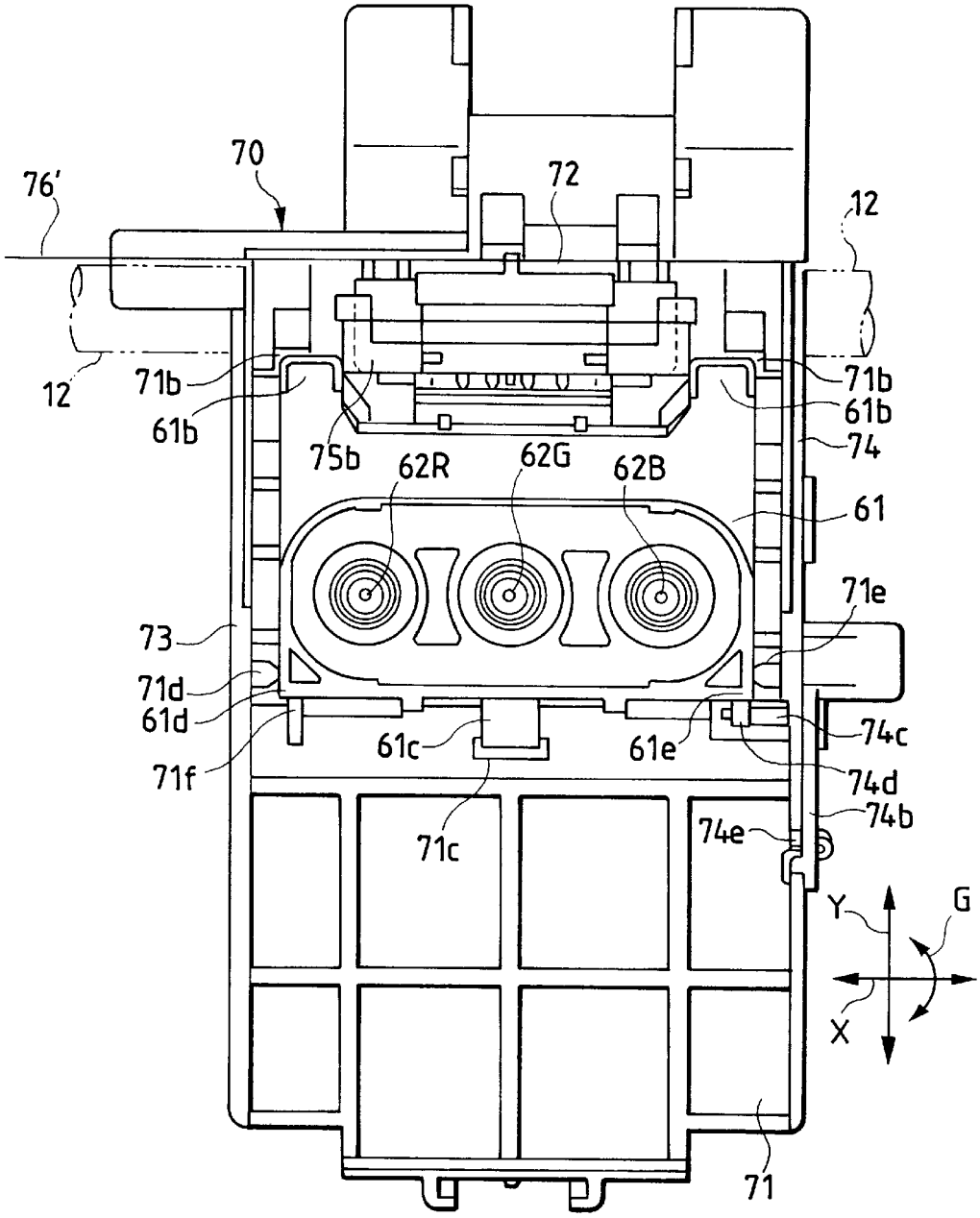
FIG. 3 is a partial bottom plan view of the carriage on which a head is mounted in accordance with the invention.
Figure 4:
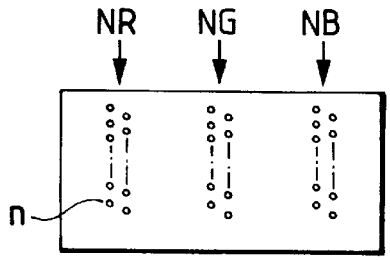
FIG. 4 is a plan view of a nozzle surface.
Figure 5:
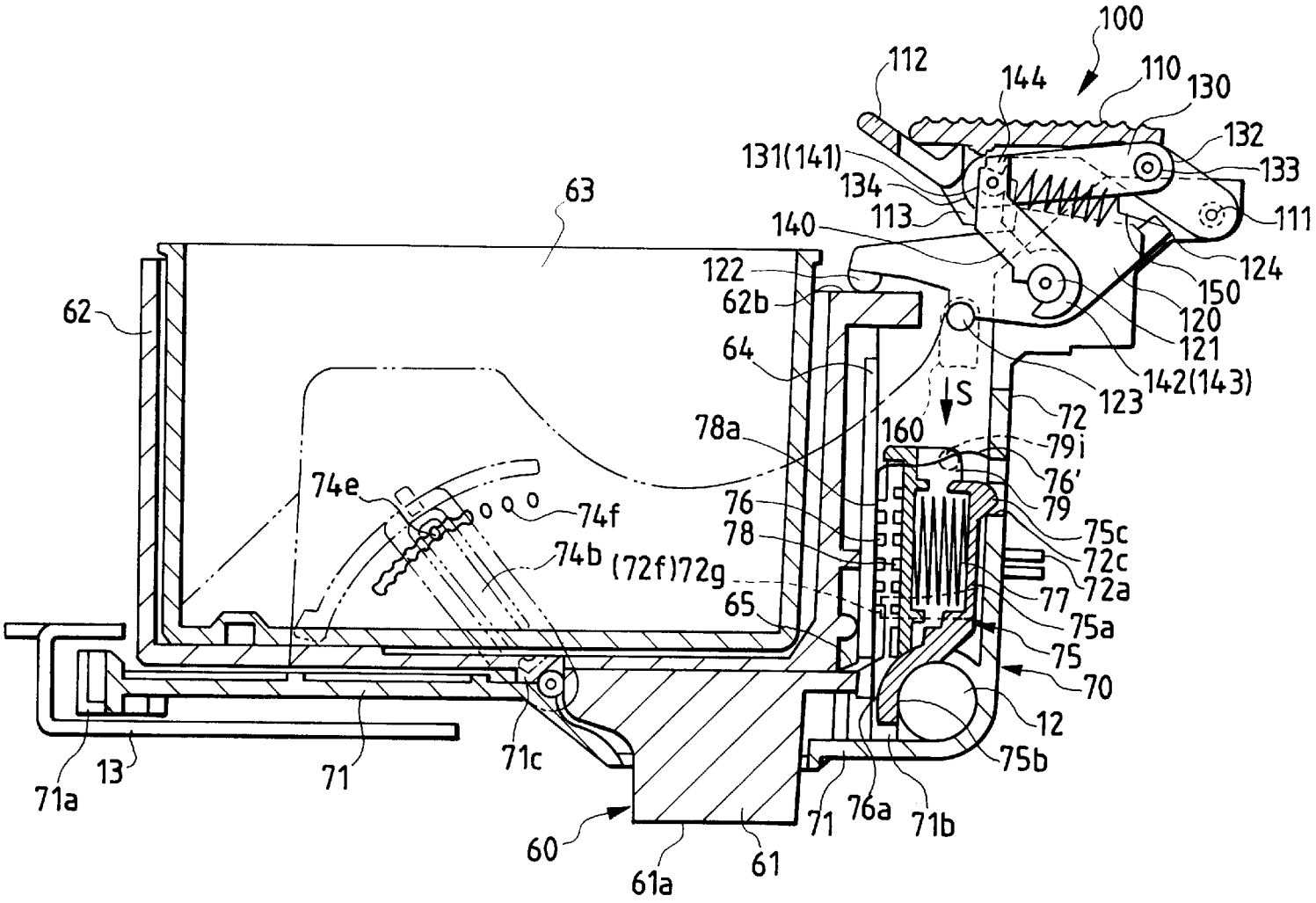
FIG. 5 is a sectional view taken along line 5—5 of FIG. 2.

Reference is now made to FIGS. 2–19 wherein the details of head 60 and carriage 70 will now be described. As shown in FIGS. 2, 3 and 5, carriage 70 has a bottom plate 71, a back plate 72, a left side plate 73 and a right side plate 74. Bearing holes 73*a*, 74*a* are formed in left side plate 73 and right side plate 74, respectively, and a guide shaft 12 is received through bearing holes 73*a*, 74*a* (see FIGS. 1 and 2) and extends the width of the carriage movement path, carriage 70 being capable of reciprocal movement along guide shaft 12 in the directions of arrows E, F (see FIG. 2). As shown in FIG. 5, a front end portion 71*a* of bottom plate 71 (the left end portion opposite the end portion supported by shaft 12) is supported by a guide plate 13. Guide shaft 12 and guide plate 13 extend to side frames (not shown) on either side of main body 10. An engagement portion 72*a* for engaging a timing belt (not shown) therewith is arranged on back plate 72. Carriage 70 is guided by guide shaft 12 and guide plate 13 with the timing belt driven by a carriage motor (not shown), and as a result, carriage 70 moves reciprocally in directions indicated by arrow E, F in FIG. 2 (in directions orthogonal to the direction of sheet feeding).

As shown in FIG. 5, carriage 70 has a space S that is adjacent to both guide shaft 12 and ink jet head 60. Space S accommodates therein a pressure member 75, a first electrically connecting portion 76, and a biasing member 77 constructed, for instance, from a compression spring. However any structure capable of filling in space S and providing a pressing against the rubber pad holder 79 (described in detail below) may be used. First electrically connecting portion 76 is constructed of an end portion of FPC 76'.

Figure 6:
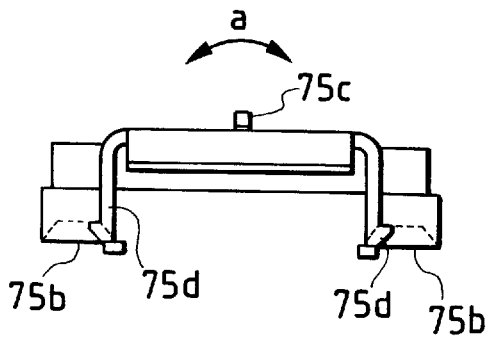
FIG. 6 is a top plan view of a pressure member constructed in accordance with the invention.
Figure 7:
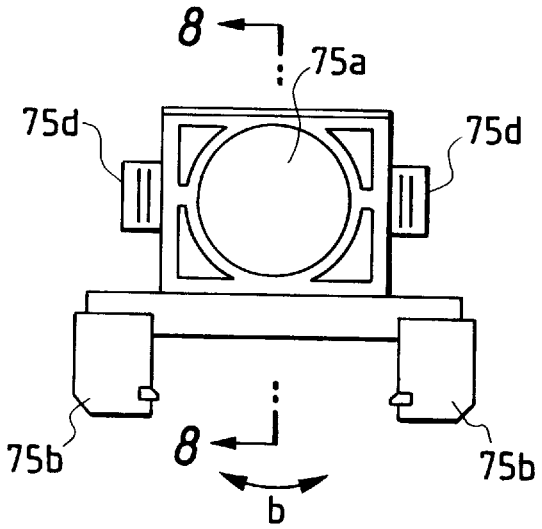
FIG. 7 is a front elevational view of the pressure member of FIG. 6.
Figure 8:
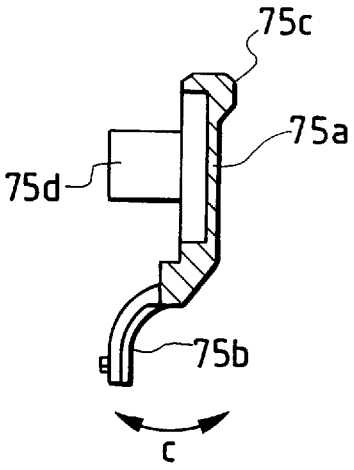
FIG. 8 is a sectional view taken along line 8—8 of FIG. 7.
Figure 9:
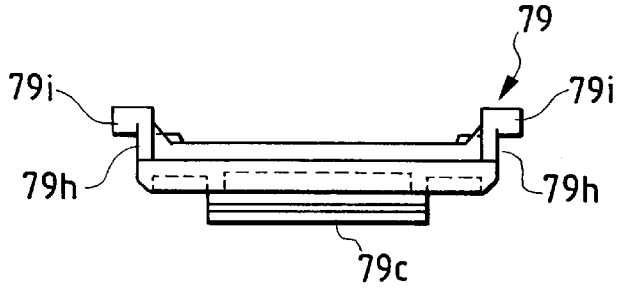
FIG. 9 is a top plan view of a rubber pad holder constructed in accordance with the invention.
Figure 11:
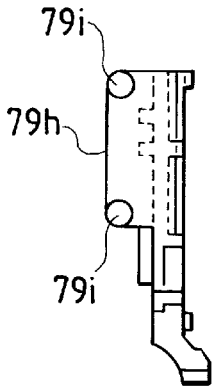
FIG. 11 is a left side elevational view of the rubber pad holder.
Figure 10:
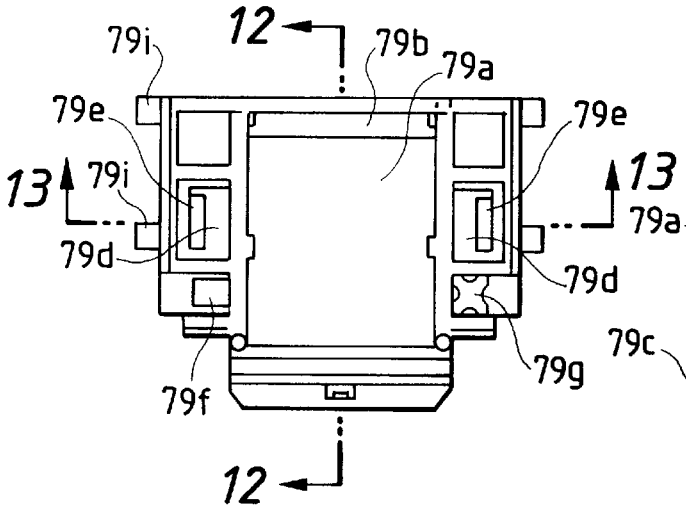
FIG. 10 is a front elevational view of the rubber pad holder.
Figure 12:
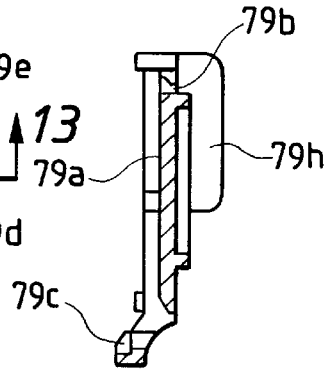
FIG. 12 is a sectional view of a rubber pad holder taken along line 12—12 of FIG. 10.
Figure 13:
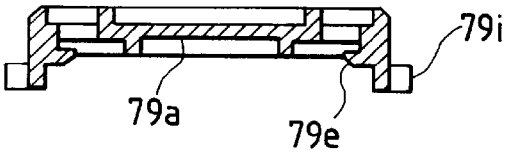
FIG. 13 is a sectional view of a rubber pad holder taken along line 13—13 of FIG. 10.
Figure 14:
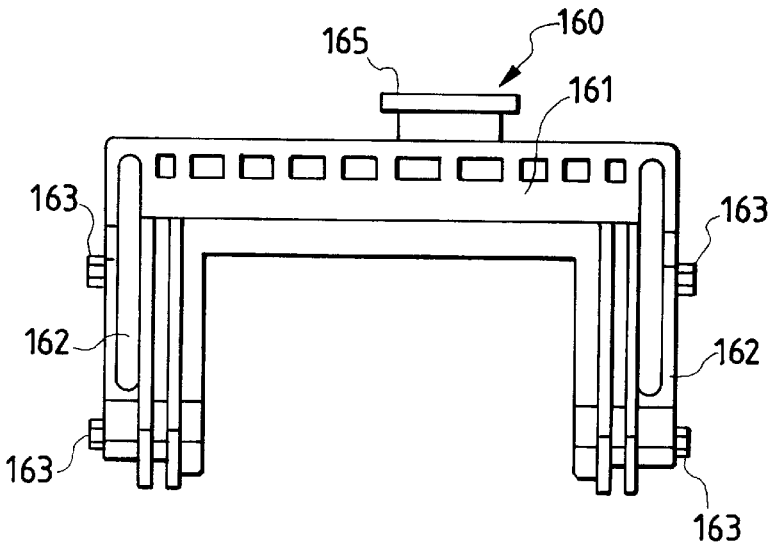
FIG. 14 is a front elevational view of a plate cam in accordance with the invention.
Figure 16:
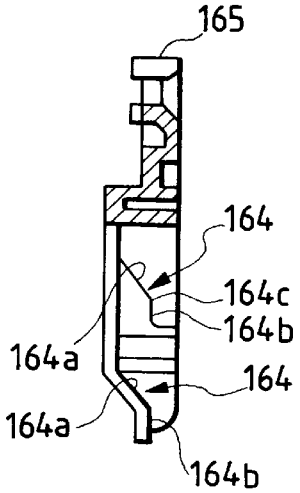
FIG. 16 is a sectional view of the plate cam taken along line 16—16 of FIG. 15.
Figure 15:
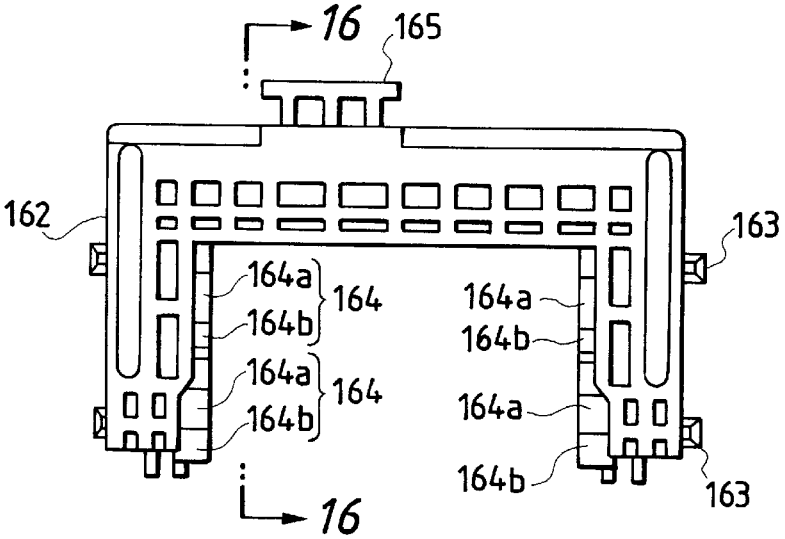
FIG. 15 is a rear elevational view of the plate cam.
Figure 17:
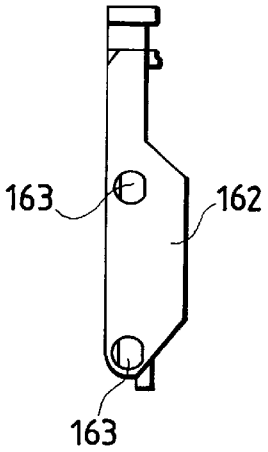
FIG. 17 is a right side elevational view of the plate cam.

Pressure member 75 will now be described. As shown in FIGS. 6–8, pressure member 75 has a receiving portion 75*a* that receives biasing member 77. Pressure member 75 also includes sliding members 75*b* that come in sliding contact with guide shaft 12. Receiving portion 75*a* is formed substantially flat as seen in FIG. 8, whereas sliding portions 75*b* are formed so as to be claw-like and hanging down from both lower side ends of receiving portion 75*a*. It is the inner surfaces of the claw-like portions that come in contact with shaft 12 and slide with respect to guide shaft 12. A projection 75*c* is formed on the upper middle of the back of receiving portion 75*a,* and projection 75*c* is softly fitted into a hole 72*c* formed in back plate 72 as shown in FIG. 5. Therefore, pressure member 75 can turn about projection 75*c* in any directions indicated by two headed arrows a, b, c shown in FIGS. 6, 7 and 8, respectively. Temporary holding hooks 75*d* engage with rubber pad holder 79 (not shown).

Reference is now made to FIGS. 9–13 wherein rubber pad holder 79 is shown. Rubber pad holder 79 is formed substantially flat, and has in the middle thereof a rubber pad fixing portion 79*a* to which a rubber pad 78 (shown in FIG. 5) is fixed by adhesion or the like. An insertion slit 79*b,* that receives FPC 76' therein is formed in the upper portion of rubber pad fixing portion 79*a*. An engagement slit 79*c* is formed in the lower portion of rubber pad fixing portion 79*a* and engages and fixes a front end portion 76*a* (FIG. 5) of FPC 76'. Further, square holes 79*d* and projections 79*e* facing square holes 79*d* are arranged on both left and right sides of rubber pad holder 79, respectively. Hooks 75*d* of pressure member 75 are inserted into square holes 79*d,* so that hooks 75*d* engage with projections 79*e* to allow rubber pad holder 79 and pressure member 75 to be releasably held.

A rectangular hole 79*f* is formed below square hole 79*d* on a first side of rubber pad holder for positioning rubber pad holder 79 that is slightly elongated leftward and rightward. An X-shaped hole 79*g* for positioning (hereinafter referred to as the "X hole") is formed below square hole 79*d* on the side of rubber pad holder 79 opposite rectangular hole 79*f.* Square pillars 72*f,* 72*g* formed on back plate 72 are inserted into positioning holes 79*f,* 79*g,* respectively, as shown in FIGS. 2 and 5. Square pillars 72*f,* 72*g* project from back plate 72 (see FIG. 2) towards space S. Rubber pad holder 79 is thus vertically positioned by the engagement of rectangular hole 79*f* with square pillar 72*f,* and vertically as well as horizontally positioned by the engagement of X hole 79*g* with square pillar 72*g.* At the same time, rubber pad holder 79 is still movable between a first direction towards carriage 70 and a second direction away from carriage 70 while being guided and positioned by square pillars 72*f,* 72*g.*

Side plates 79*h* are formed on both sides of rubber pad holder 79. A total of 4 pins 79*i* are arranged on side plates 79*h,* two pins aligned vertically on each side plate. On the back of rubber pad holder 79 is a plate cam 160 (described in detail below). Plate cam 160 moves vertically so as to be interlocked with a head fixing lever mechanism 100, to be described later. Pins 79*i* come in contact with the cam surface (not shown). As a result of this construction, the vertical movement of plate cam 160, i.e., the operation of the head fixing lever mechanism, interlocks with the forward and backward movement of rubber pad holder 79.

Front end portion 76*a* of FPC 76' passes through insertion slit 79*b* of rubber pad holder 79 and by the front of rubber pad 78 to engagement slit 79*c*. FPC 76' thus forms a first electrically connecting portion 76 in the front of rubber pad 78. A plurality of connecting points are formed on the surface of electrically connecting portion 76. A plurality of projections 78*a* are formed on rubber pad 78 so as to correspond to these connecting points. The other end of FPC 76' is typically connected to a control section 14 (see FIG. 1) of main body 10.

Ink jet head 60 will now be described. As shown in FIG. 5, ink jet head 60 has a case section 62 and a nozzle section 61 mounted thereon. Head 60 shown in FIG. 4 is adapted for full-color printing. As shown in FIG. 4, the lower surface 61*a* of nozzle section 61, (i.e., the surface confronting the paper), has a red ink jetting nozzle array NR, a green ink jetting nozzle array NG, and a blue ink jetting nozzle array NB. Each nozzle array has a total of 24 nozzles n, formed in two rows, each row consisting of 12 nozzles. A grand total of 72 nozzles are provided on nozzle surface 61*a* in a preferred embodiment, but any number of nozzles capable of producing a figure may be used.

An ink cartridge 63 is mounted in case section 62. A lever for fixing ink cartridge 63 (not shown) is arranged in case section 62. Ink cartridge 63 is partitioned into 3 ink chambers. The ink chambers contain red ink, green ink, and blue ink, respectively, by way of example but may contain any color ink.

Three needles, 62R, 62G, 62B (FIG. 3), each having a flow path into the respective ink chambers, are arranged in a bottom plate 62*a* of case section 62. When ink cartridge 63 is attached to case section 62, the respective needles 62R, 62G, 62B extend into ink chambers of ink cartridge 63, and supply the red, the green, and the blue ink, respectively, to nozzle arrays NR, NG, NB via the flow paths thereof. Nozzle section 61 has built-in drive elements corresponding to the respective nozzles. It is by selectively operating these elements that ink drops are jetted out of the nozzles for forming an image on the paper.

A second electrically connecting portion 64 is formed on the portion of case section 62 facing space S. Second electrically connecting portion 64 is constructed of a electrical circuit board and has a connecting portion on a surface of the board. The electrical connection is disposed within main body 10 to electrically connect the connecting points of first electrically connecting portion 76 when in pressure contact with the connecting points of second electrically connecting portion 64 when ink jet head 60 is in carriage 70. Second electrically connecting portion 64 is connected to the drive elements in nozzle section 61 via a second FPC 65 mounted on carriage 70.

Positioning head 60 while head 60 is attached to carriage 70 is performed in the following way. Because nozzle positioning accuracy is an important factor for ink jet printers, the positioning operation is performed at nozzle section 61. Nozzle section 61 is constructed as a separate part from case section 62 and is put under dimensional control that is more stringent than is required for case section 62. Case section 62 is omitted in FIG. 3 in order to facilitate the understanding of how the positioning operation is performed. As shown in FIG. 3, projecting pieces 61*b* extending towards back plate 72 are formed on both ends of the back of nozzle section 61. The lower surface of each projecting piece 61*b* comes in contact with the upper surface of a corresponding rib 71*b* formed on bottom plate 71 of carriage 70 (see FIG. 3). Further, a projecting piece 61*c* extending in a horizontal direction is formed in the middle of the front of nozzle section 61. The lower surface of projecting piece 61*c* comes in contact with the upper surface of a rib 71*c* formed on bottom plate 71 of carriage 70. As a result of this construction, nozzle section 61 is positioned in the directions orthogonal to the paper sheet feed path.

Two ribs 71*d*, 71*e* that are formed substantially in the middle of the upper surface of bottom plate 71 of carriage 70 and extend towards each other. The inner surfaces of ribs 71*d*, 71*e* come in contact with the side surface of a first left corner portion 61*d* and that of a second right corner portion 61*e* of nozzle section 61, respectively. As a result of this construction, nozzle section 61 is prevented from movement coplanar to the paper feed path; in the direction indicated by an arrow X of FIG. 3.

A rib 71*f* is formed substantially in the middle of the left side upper surface of bottom plate 71 of carriage 70 and extends in the direction indicated by an arrow Y. The back of rib 71*f* comes in contact with the front of left corner portion 61*d* of nozzle section 61. Further, an adjusting lever 74*b* (FIG. 5) is rotatably mounted on a right side plate 74 of carriage 70 so as to be rotatable about a shaft 74*c* thereof. Shaft 74*c* has an eccentric cam 74*d* which comes in contact with the front of right corner portion 61*e* of nozzle section 61. Pin 74*e* is provided in adjusting lever 74*b*. A plurality of holes 74*f* engageable with and disengageable from pin 74*e* are formed in right side plate 74, so that unwanted rotation of lever 74*b* can be prevented by engaging pin 74*e* with any one of holes 74*f* after horizontal adjustment of nozzle section 61 has been made by rotating lever 74*b*. It may be noted that adjusting lever 74*b* rotating operation is typically performed at the factory or the like and therefore that users are not usually required to perform this operation.

When head 60 is attached to carriage 70, head 60 is biased away from space S by biasing member 77 as will be described later. Therefore, nozzle section 61 is positioned in the direction indicated by arrow Y of FIG. 3. Further, since nozzle section 61 may also be rotated in the direction indicated by an arrow G in FIG. 3 by rotating adjusting lever 74*b*, nozzle section 61 may be aligned horizontally with respect to guide shaft 12 and can be finely adjusted.

As is apparent mainly from FIG. 5, all of first electrically connecting portion 76, second electrically connecting portion 64, and receiving portion 75*a* of pressure member 75 are arranged in parallel with guide shaft 12 in space S.

It may also be noted that the ink jet printer of the invention has a monochromatic printing head 60' in addition to the full-color printing head 60 (see FIG. 1). Monochromatic printing head 60' has exactly the same external form as full-color printing head 60. What is different is only the number of nozzles and portions corresponding to the nozzles, i.e., the number of drive elements and the number of needles or the like for introducing ink. For example, monochromatic printing ink jet head 60' may have a total of 48 nozzles with 4 nozzle arrays (each nozzle array consisting of 12 nozzles) and a single needle that communicates with these nozzles.

A head fixing lever mechanism 100, as shown in FIG. 5 is also provided, and has an operation lever 110, rotatably mounted to carriage 70 by a shaft 111 thereof. A grip 112 is provided on an end of operation lever 110, and a hook 113 is arranged on the lower end of grip 112.

A head pressing lever 120 is rotatably attached to carriage 70 by a shaft 121. A projecting portion 122 extends from one end of head pressing lever 120 and presses an upper surface 62*b* of case 62 of head 60. Plate cam 160 is coupled by a coupling portion 123 between projecting portion 122 and shaft 121. Further, engagement portions 124 arranged on the back end of head pressing lever 120 engage with two springs 150.

An end of a first link 130 and an end of a second link 140 are rotatably coupled by a coupling portion 131 (141). The other end 132 of first link 130 is rotatably coupled to operation lever 110 by a pin 133, and the other end 142 of second link 140 is rotatably coupled to shaft 121 of head pressing lever 120 by a hook 143. Engagement portions 144 that engage with springs 150 are arranged on the end of second link 140. Each spring 150 extends between the corresponding engagement portion 124 of head pressing lever 120 and the corresponding engagement portion 144 of second link 140.

FIG. 5 shows head 60 attached to carriage 70. In this condition, projecting portion 122 of head pressing lever 120 comes in contact with upper surface 62*b* of case section 62 of head 60, and fixes head 60 to carriage 70 by pressing head 60 towards bottom plate 71 with the biasing force of springs 150. This condition is locked by hook 113 of operation lever 110 engaging with an end 134 of first link 130. Further, in this condition, plate cam 160 is in the lower position, which releases the regulation of rubber pad holder 79. Therefore, rubber pad holder 79 brings first electrically connecting portion 76 into pressure contact with second electrically connecting portion 64 of head 60 by the action of biasing member 77 through rubber pad 78. Additionally, pressure member 75 is biased by biasing member 77 about projection 75 in the counterclockwise direction, as viewed in FIG. 5, whereby sliding portions 75*b* come in contact with guide shaft 12.

Plate cam 160 (FIGS. 14–17) includes a horizontal member 161, and a pair of vertical members 162 which are extended downwardly from both ends of horizontal member 161; that is, it is substantially U-shaped, embracing rubber pad holder 79 (FIG. 2).

Figure 18:
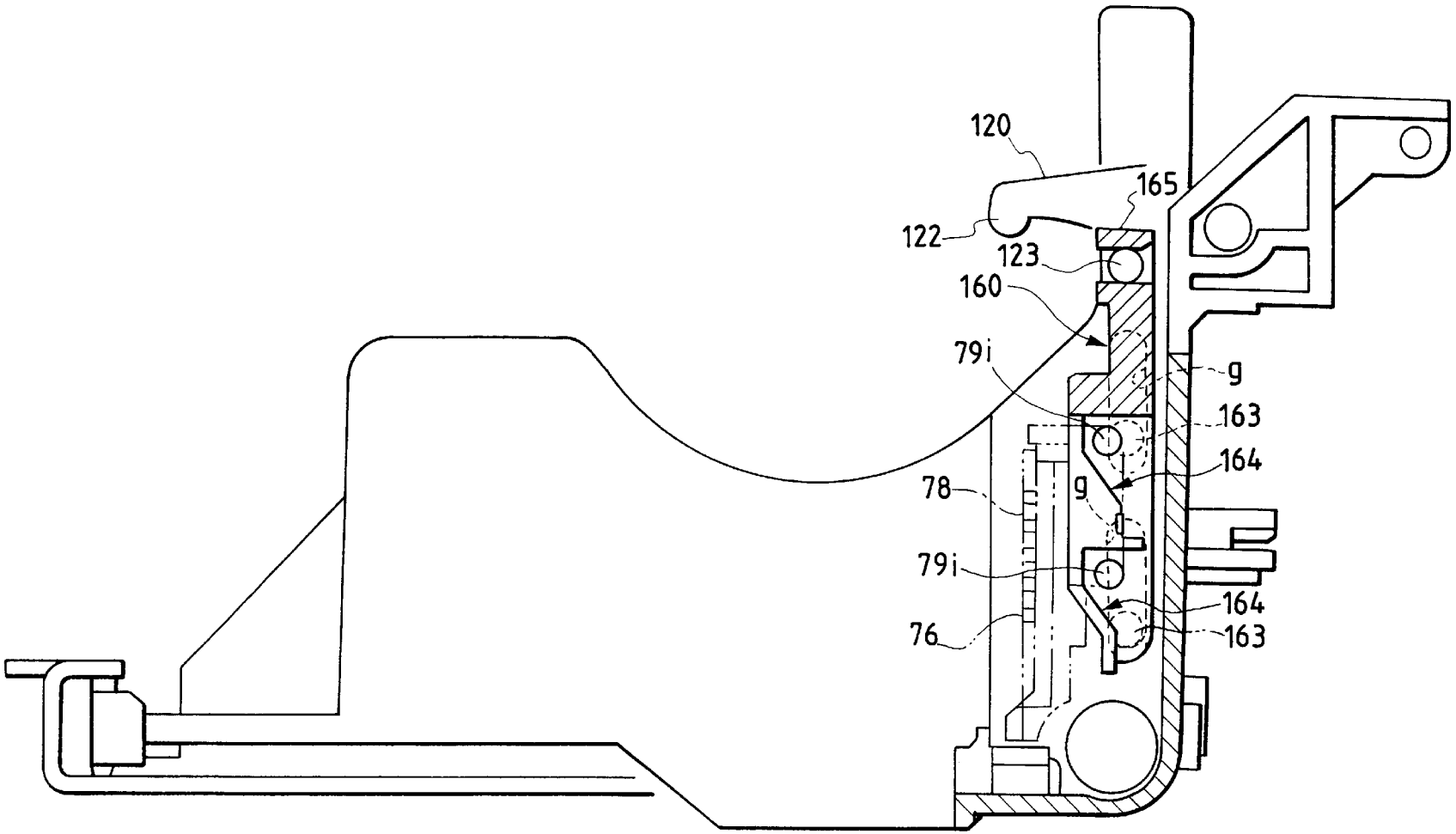
FIG. 18 is an explanatory diagram for describing the operation of a head fixing lever and plate cam, when in the lower position, in accordance with the invention.
Figure 19:
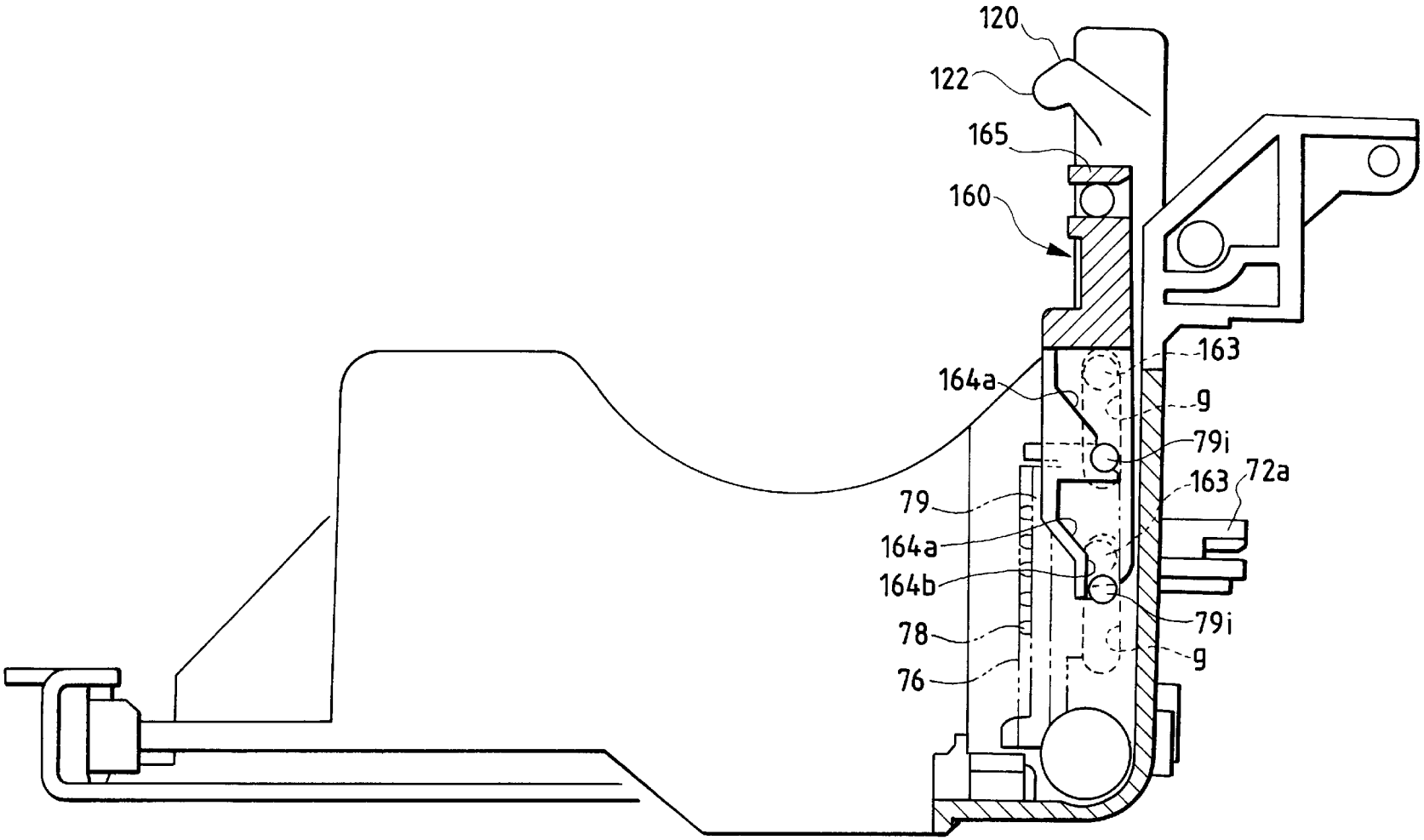
FIG. 19 is an explanatory diagram for describing the head fixing lever and plate cam, when in an upper position.
Figure 20:
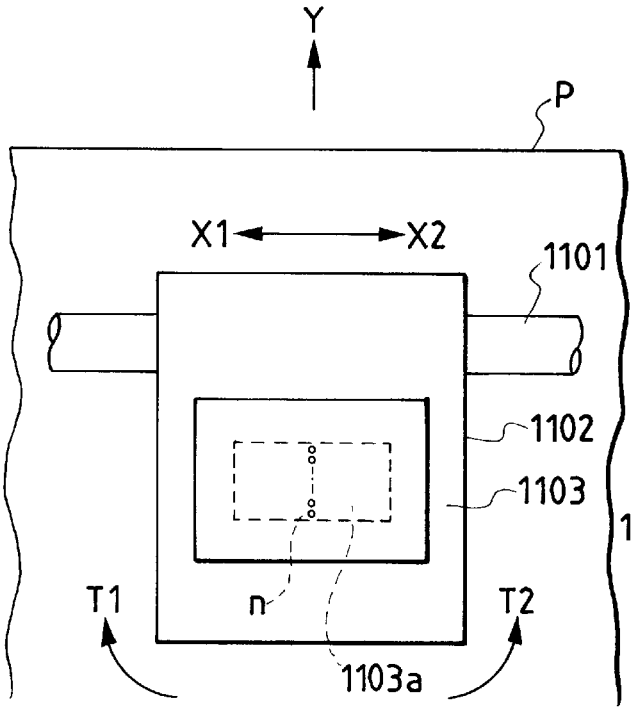
FIG. 20 PRIOR ART
FIG. 20 is a bottom plan view of a carriage and ink jet head in accordance with the prior art.
Figure 21:
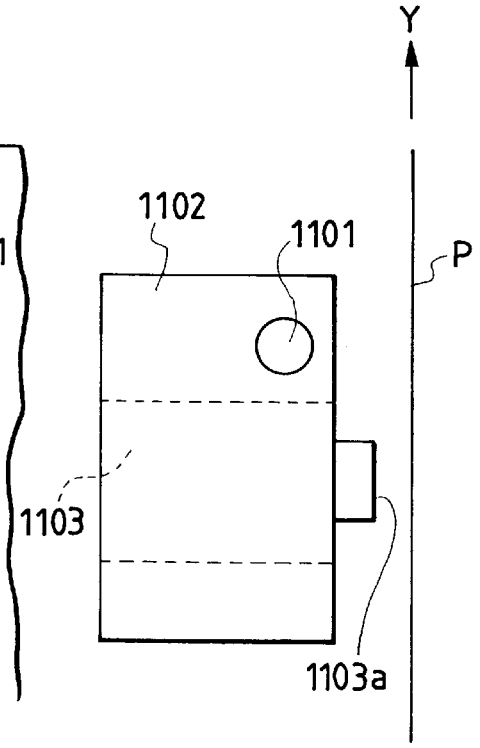
FIG. 21 PRIOR ART
FIG. 21 is a side elevational view of the carriage of FIG. 20.
Figure 22:
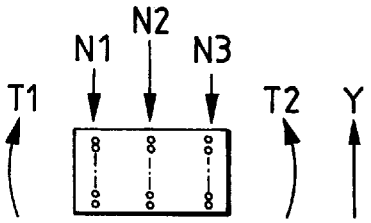
FIG. 22 PRIOR ART
FIG. 22 is a plan view of a nozzle surface constructed in accordance with the prior art.
Figure 23:
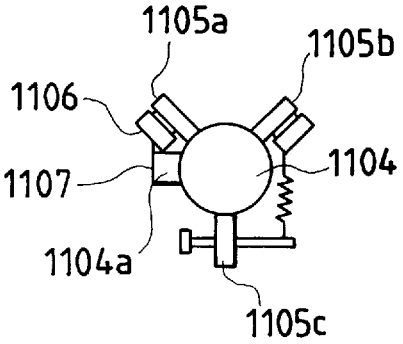
FIG. 23 PRIOR ART
FIGS. 23–25 are perspective views showing examples of structures for biasing a carriage to a guide shaft constructed in accordance with the prior art.
Figure 24:
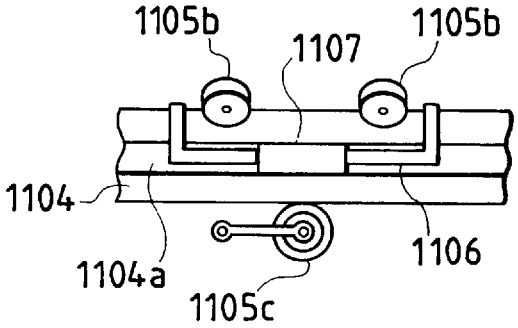
FIG. 24 PRIOR ART
Figure 25:
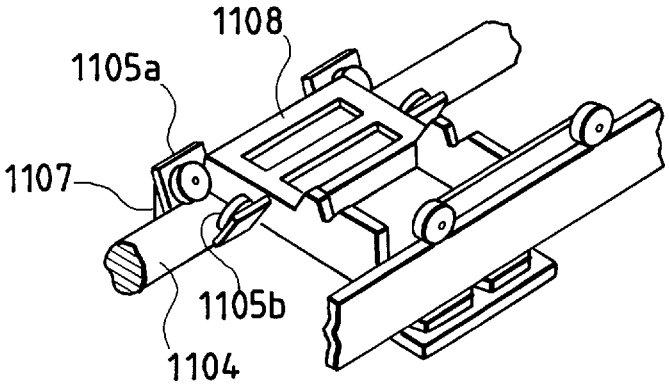
FIG. 25 PRIOR ART
Figure 26:
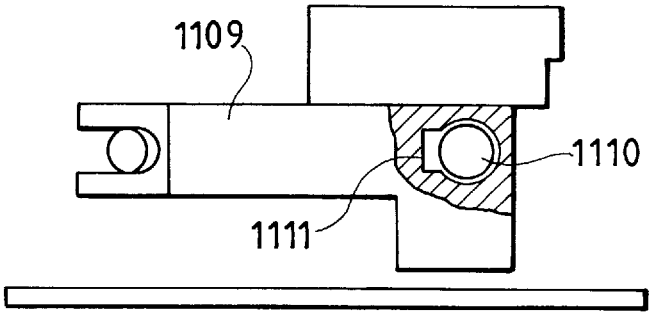
FIG. 26 PRIOR ART
FIG. 26 is a fragmented side elevational view of another structure for biasing a carriage to a guide shaft constructed in accordance with the prior art.
Figure 27:
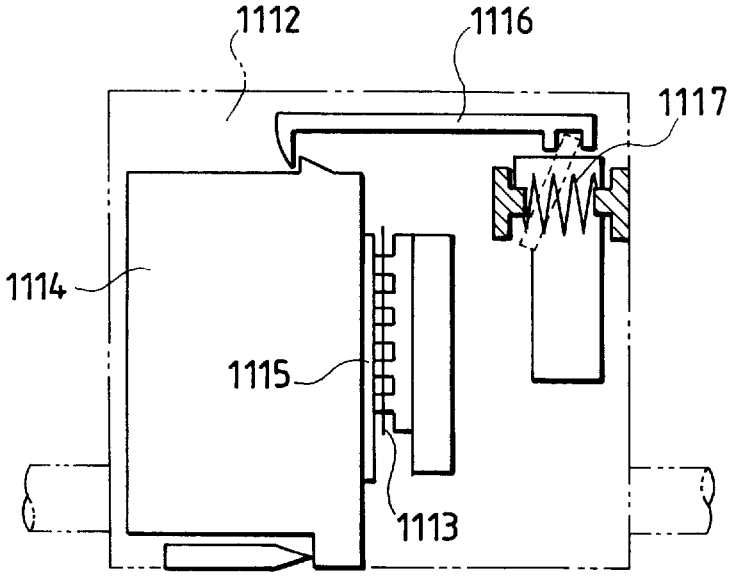
FIG. 27 PRIOR ART
FIG. 27 is a side elevational view of a head in electrical connection with a carriage constructed in accordance with the prior art.

Each of vertical members 162 has upper and lower pins 163 on its outer edge. Pins 163 of vertical members 162, as shown in FIGS. 2, 18 and 19, are engaged with elongated holes G formed in left side plate 73 and right side plate 74 of carriage 70. With pins 163 being guided by elongated holes G, plate cam 160 is vertically movable. The sliding portions of pins 163 which are brought into sliding contact with elongated holes G are flattened to increase their wear resistance.

Each of vertical members 162 has upper and lower cam surfaces 164 in its rear surface, in such a manner that pins 79*i* of rubber pad holder 79 are abutted against cam surfaces 164, respectively. Each of cam surfaces 164 is made up of an inclined surface 164*a* and a vertical surface 164*b* (parallel with the direction of movement of plate cam 160). In each of upper cam surfaces 164, a clicking protrusion is formed along the borderline between inclined surface 164*a* and vertical surface 164*b* so that the respective pin is clicked when operated. The four inclined surfaces 164*a* are all equal in the angle of inclination to each other; that is, they are all in parallel with one another.

A locking piece 165 is extended from the upper edge of the horizontal member 161. Locking piece 165 is coupled to a hook-shaped coupling portion 123 of head fixing lever mechanism 100, so that the vertical motion of plate cam 160 is effected in association with the operation of head fixing lever mechanism 100. As shown in FIG. 5, the ink jet type recording head 60 includes the aforementioned nozzle section 61, and casing 62.

FIG. 5 shows how head 60 is mounted on carriage 70. Protrusion 122 of pressing lever 120 abuts against upper surface 62*b* of case 62 of head 60, and head 60 is secured to carriage 70 with head 60 pushed downwardly by the elastic force of spring 150. Under this condition, operating lever 110 is locked with its hook 113 engaged with a front end portion 134 of first link 130. In this state, as shown in FIG. 18, plate cam 160 is located in its lower position, so that the cam surfaces 164 are disengaged from pins 79*i* of pad holder 79. Hence, rubber pad holder 79 pushes first electrical connecting section 76 against the second electrical connecting section 64 through rubber pad 78 with the aid of biasing member 77.

To remove head 60, one rotates grip 112 of operation lever 110 in the clockwise direction as viewed in FIG. 5. As a result, grip 112 rotates relative to operation lever 110 by its own elastic deformation. As a result, hook 113 is released from end 134 of first link 130 to cause operation lever 110 to rotate. In synchronism therewith, pressing lever 120 rotates to allow head 60 to be released. When pressing lever 120 rotates, plate cam 160 moves upward in a direction out of space S, which in turn causes rubber pad holder 79 to retreat away from head 60 against the biasing force of biasing member 77. Therefore, at the time of taking head 60 out, pressure contact between first electrically connecting portion 76 on the side of carriage 70 and second electrically connecting portion 64 on the side of head 60 is released. This construction prevents the likelihood that electrical connection between first electrically connecting portion 76 and second electrically connecting portion 64 will be destroyed due to first electrically connecting portion 76 rubbing second electrically connecting portion 64 at the time of attaching or removing head 60.

As head pressing lever 120 is turned in the above described manner, as shown in FIG. 19, plate cam 160 is moved upwardly so that cam surfaces 164 abut against pins 79*i* of rubber pad holder 79, thus pushing pins 79*i* to the right in FIG. 19. As a result, rubber pad holder 79 is moved to the right in FIG. 5 against the elastic force of biasing member 77. In this operation, since inclined surfaces 164*a* of cam surfaces 164 are equal in the angle of inclination to one another, rubber pad holder 79 is retracted in the direction which is perpendicular to the contact surfaces of the first and second electrical connecting sections 76 and 64 while maintaining those electrical connecting sections in parallel with each other.

Hence, in removing head 60, first electrical connection section 76 on the side of the carriage, and second electrical connection section 64 on the side of head 60 are loosened from each other and disconnected. Therefore, in this case, those electrical connecting sections, 76 and 64, respectively, are prevented from being roughly rubbed by each other, or from being damaged. In the case where, under the conditions shown in FIG. 19, head 60 is mounted again, rubber pad holder 79 has been retracted to the right. Hence, head 60 can be smoothly and readily mounted on carriage 70, with first and second electrical connecting sections, 76 and 64, respectively, not being rubbed by each other. Thereafter, operating lever 110 is turned. As a result, head pressing lever 120 is also turned to fix unit 60, and hook 113 is engaged with end portion 134 of first link 130, whereby the unit is fixedly secured thereto.

As the head pressing lever 120 is turned, plate cam 160 is moved downwardly, so that cam surfaces 164 are disengaged from pins 79*i* of rubber pad holder 79. Hence, rubber pad holder 79 pushes first electrical connecting section 76 against second electrical connecting section 64 of head 60 through rubber pad 78 with the aid of biading member 77. In the case where cam surfaces 164 of plate cam 160 are disengaged from pins 79*i* of rubber pad holder 79 as was described above, pins 79*i* are caused to slide down the inclined surfaces 164*a*. Hence, rubber pad holder 79 gradually pushes first electrical connecting section 76 against second electrical connecting section 64 while maintaining those electrical connecting sections parallel with each other.

According to the ink jet printer of the invention, the following advantages can be obtained:

(i) Carriage 70 moves alternately in both directions while guided by guide shaft 12, whereby ink is jetted out of ink jet head 60 to print ink drops on a paper thereby forming an image. Since the pressing force is given by biasing member 77 between guide shaft 12 and carriage 70, play between carriage 70 and guide shaft 12 is prevented, thus allowing nozzle section 61 to be well aligned and allow high quality images to be formed.

Further, electrical connection between carriage 70 and ink jet head 60 is provided by first electrically connecting portion 76 arranged on carriage 70 and second electrically connecting portion 64 arranged on ink jet head 60 being selectively brought into pressure contact with each other. Therefore, ink jet head 60 can be releasably attached to carriage 70.

Biasing member 77 that provides a biasing force to press first electrically connecting portion 76 into contact with second electrically connecting portion 64 is also used as a biasing member that presses carriage 70 towards guide shaft 12. Therefore, the number of biasing members is reduced. Hence, according to the ink jet printer of the invention, not only can play between carriage 70 and guide shaft 12 be minimized or eliminated, but also head 60 can be releasably attached to carriage 70 and the electrical connection between head 60 and carriage 70 can be provided reliably with a reduced number of parts.

(ii) Ink jet head 60 has a plurality of nozzle arrays arranged in the carriage moving direction. Therefore, printing with a higher resolution can be obtained. Since ink jet head 60 has a plurality of nozzle arrays arranged in the carriage moving direction, the play of the carriage at the time of moving in either direction would aggravate impairment in printing quality. However, according to the ink jet printer of this invention, pressing force between carriage 70 and guide shaft 12 is given by biasing member 77, and therefore, play between carriage 70 and guide shaft 12 is prevented, thus allowing printing with a higher resolution to be obtained and excellent images to be formed. In addition, fewer parts are needed.

(iii) Monochromatic printing ink jet head 60' and color printing ink jet head 60 may be used as the ink jet head in the ink jet printer of this invention. Therefore, monochromatic prints can be made by attaching monochromatic printing ink jet head 60' to carriage 70, and color prints can be made by attaching color printing ink jet head 60 in place of monochromatic printing ink jet head 60' to carriage 70.

In the case where color images, or full-color images in particular, are made, red, blue, and yellow inks must be jetted out in careful alignment. Therefore, color printing ink jet head 60 of this embodiment has a total of 6 nozzle arrays NR, NG, NB arranged in the carriage moving direction.

Should carriage 70 play when moving in both directions in this case, printing quality is further impaired due to the varying offset from the axis of rotation. However, the ink jet printer according to this invention can prevent play between carriage 70 and guide shaft 12. Therefore, an excellent color image can be produced. In addition, less parts and a smaller size can be attained since biasing member 77 for allowing replacement of the head serves also as biasing member 77 for preventing play. That is, a small-sized ink jet printer capable of providing high quality monochromatic as well as color printing can be obtained.

(iv) Carriage 70 has positioning members 71*f*, 74*d* for regulating the mounting position of ink jet head 60 (or 60'; the same shall apply hereinafter), and ink jet head 60 is biased by biasing member 77 toward these positioning members. Therefore, ink jet head 60 is always positioned properly, which in turn allows high quality images to be formed. Since biasing member 77 for preventing play also serves as biasing member 77 to ensure a reliable electrical connection, carriage 70 can be made less complex, with fewer parts.

(v) In the ink jet printer of the invention, carriage 70 has a space S adjacent to both guide shaft 12 and ink jet head 60, and biasing member 77 is accommodated in space S, further reducing the size required to accommodate biasing member 77.

(vi) First electrically connecting portion 76, second electrically connecting portion 64, and receiving portion 75*a* of pressure member 75 may all be arranged in parallel with guide shaft 12 in space S, thus even further reducing the size needed to accommodate pressure member 75 and rubber pad holder 79.

While embodiments of the invention have been described in the foregoing, the invention is not limited to the aforementioned embodiments, but may be embodied while being modified appropriately within the scope and sprint of the invention.

According to the ink jet printer of this invention, not only play between the carriage and the guide shaft can be eliminated, and but also the head can be releasably attached to the carriage and electrical connection between the head and the carriage can be provided reliably with a reduced number of parts.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ink jet printer comprising:

a guide shaft extending in a direction orthogonal to a paper sheet feed path;

a carriage mounted on said guide shaft and capable of moving reciprocally along said guide shaft;

an ink jet head releasably attached to said carriage, said ink jet head having nozzles thereon for jetting ink; said ink jet head capable of printing ink on a paper by jetting ink out of said nozzles;

a first electrically connecting portion arranged on said carriage;

a second electrically connecting portion arranged on said ink jet head; and a biasing member for pressing said first electrically connecting portion into contact with said second electrically connecting portion when said ink jet head is attached to said carriage, and providing a pressing force between said carriage and said guide shaft in a direction perpendicular to the direction of the extension of said guide shaft.

2. An ink jet printer according to claim 1, wherein said nozzles are formed from a plurality of nozzle arrays on said ink jet head, said nozzle arrays being in the direction orthogonal to a direction in which paper is fed along said paper feed path.

3. An ink jet printer according to claim 2, wherein said ink jet head is a monochromatic ink jet head.

4. An ink jet printer according to claim 2, wherein said ink jet head is a color printing ink jet head.

5. An ink jet printer according to claim 2, further comprising positioning members formed on said carriage for regulating a position at which the ink jet head is attached, and wherein the biasing member biases the ink jet head toward the positioning members.

6. An ink jet printer according to claim 1, wherein said ink jet head is a monochromatic ink jet head.

7. An ink jet printer according to claim 1, wherein said ink jet head is a color printing ink jet head.

8. An ink jet printer according to claim 1, further comprising positioning members formed on said carriage for regulating a position at which the ink jet head is attached, and wherein the biasing member biases the ink jet head toward the positioning members.

9. An ink jet printer comprising:

a guide shaft extending in a direction orthogonal to a paper sheet feed path;

a carriage mounted on said guide shaft and capable of moving reciprocally along said guide shaft;

an ink jet head releasably attached to said carriage, said ink jet head having nozzles thereon for jetting ink; said ink jet head capable of printing ink on a paper by jetting ink out of said nozzles; said carriage including a space adjacent to both the guide shaft and the ink jet head;

a first electrically connecting portion arranged on said carriage;

a second electrically connecting portion arranged on said ink jet head; and a biasing member disposed within said space adjacent to both the guide shaft and the ink jet head for pressing said first electrically connecting portion into contact with said second electrically connecting portion when said ink jet head is attached to said carriage, and providing a pressing force between said carriage and said guide shaft in a direction perpendicular to the direction of the extension of said guide shaft.

10. An ink jet printer according to claim 9, wherein the biasing member includes a compression spring; the carriage includes a pressure member with a sliding portion thereon, said pressure member having a receiving portion for receiving said compression spring, said sliding portion coming in sliding contact with the guide shaft; the first electrically connecting portion has an end thereof connected to an electronic control section of the ink jet printer and another end thereof forming an end of a flexible printed cable arranged in parallel with the guide shaft within the carriage;

the second electrically connecting portion including a board arranged in parallel with the end of said flexible printed cable; and said receiving portion of said pressure member and the end of said flexible printed cable being arranged in parallel with the guide shaft in the space.

11. An ink jet printer according to claim 10, further comprising a cam plate, said cam plate engaged with said pressure member; and a head fixing lever, said head fixing lever rotatably attached to said cam plate and having a portion thereof in pressing engagement with said carriage, and a case wherein said head fixing lever being rotatably mounted within said case to rotate in a direction away from said carriage, raising said cam plate and releasing engagement with said carriage, said cam plate moving said pressure member away from said carriage, whereby said biasing member releases said pressing force between said guide shaft and said carriage and simultaneously releases said pressing force between said first electrically connected portion and second electrically connected portion for allowing removal of said carriage.

12. An ink jet printer according to claim 11, wherein said cam plate causes said sliding portion to release from said sliding contact with the guide shaft.

13. An ink jet printer according to claim 9, wherein said nozzles are formed from a plurality of nozzle arrays on said ink jet head, said nozzle arrays being in the direction orthogonal to a direction in which paper is fed along said paper feed path.

14. An ink jet printer according to claim 13, further comprising a space formed within said carriage adjacent to both the guide shaft and the ink jet head, and wherein the biasing member is disposed within said space adjacent to both the guide shaft and the ink jet head.

15. An ink jet printer according to claim 14, wherein the biasing member includes a compression spring; the carriage includes a pressure member with a sliding portion thereon, said pressure member having a receiving portion for receiving said compression spring, said sliding portion coming in sliding contact with the guide shaft; the first electrically connecting portion has an end thereof connected to an electronic control section of the printer ink jet and another end thereof forming an end of a flexible printed cable arranged in parallel with the guide shaft within the carriage; the second electrically connecting portion including a board arranged in parallel with the end of said flexible printed cable; and said receiving portion of said pressure member and the end of said flexible printed cable being arranged in parallel with the guide shaft in the space.

16. An ink jet printer according to claim 15, further comprising a cam plate, said cam plate engaged with said pressure member; and a head fixing lever, said head fixing lever rotatably attached to said cam plate and having a portion thereof in pressing engagement with said carriage; and a case wherein said head fixing lever is rotatably mounted within said case to rotate in said direction away from said carriage, raising said cam plate and releasing engagement with said carriage, said cam plate moving said pressure member away from said carriage, whereby said biasing member releases said pressing force between said guide shaft and said carriage and simultaneously releases said pressing force between said first electrically connected portion and second electrically connected portion for allowing removal of said carriage.

17. An ink jet printer according to claim 16, wherein said cam plate causes said sliding portion to release from said sliding contact with the guide shaft.

18. An ink jet printer according to claim 9, further comprising:

positioning members formed on said carriage for regulating a position at which the ink jet head is attached; said biasing member biasing the ink jet head toward the positioning members.

19. An ink jet printer according to claim 18, wherein the biasing member includes a compression spring; the carriage includes a pressure member with a sliding portion thereon, said pressure member having a receiving portion for receiving said compression spring, said sliding portion coming in sliding contact with the guide shaft; the first electrically connecting portion has an end thereof connected to an electronic control section of the printer ink jet and another end thereof forming an end of a flexible printed cable arranged in parallel with the guide shaft within the carriage; the second electrically connecting portion including a board arranged in parallel with the end of said flexible printed cable; and said receiving portion of said pressure member and the end of said flexible printed cable being arranged in parallel with the guide shaft in the space.

20. An ink jet printer according to claim 19, further comprising a cam plate, said cam plate engaged with said pressure member; and a head fixing lever, said head fixing lever rotatably attached to said cam plate and having a portion thereof in pressing engagement with said carriage, and a case wherein said head fixing lever being rotatably mounted within said case to rotate in a direction away from said carriage, raising said cam plate and releasing engagement with said carriage, said cam plate moving said pressure member away from said carriage, whereby said biasing member releases said pressing force between said guide shaft and said carriage and simultaneously releases said pressing force between said first electrically connected portion and second electrically connected portion for allowing removal of said carriage.

21. An ink jet printer according to claim 20, wherein said cam plate causes said sliding portion to release from said sliding contact with the guide shaft.

* * * * *